United States Patent [19]

Kobayakawa et al.

[11] 3,958,150

[45] May 18, 1976

[54] MULTI-DIGIT LUMINESCENCE DISPLAY TUBE HAVING MEANS FOR SUPPLYING A POSITIVE OR ZERO VOLTAGE TO A SELECTED GRID TO SUPPRESS LUMINESCENCE OF ANODE SEGMENTS COVERED THEREBY

[75] Inventors: Masaki Kobayakawa; Kazufumi Yawata; Hideo Murayama; Itsuo Matsusaki, all of Izumi, Japan

[73] Assignee: Nippon Electric Kagoshima, Ltd., Izumi, Japan

[22] Filed: July 30, 1974

[21] Appl. No.: 493,656

[30] Foreign Application Priority Data

July 31, 1973 Japan ..... 48-86617

[52] U.S. Cl. ..... 315/169 TV; 313/497; 313/513

[51] Int. Cl.[2] ..... H01J 1/66; H01J 63/06; H05B 37/00

[58] Field of Search ..... 313/495, 496, 497, 169 TV, 313/513

[56] References Cited

UNITED STATES PATENTS

| | | | |
|---|---|---|---|
| 3,508,101 | 4/1970 | Tanji | 313/497 |
| 3,571,655 | 3/1971 | Tanimoto | 315/169 R |
| 3,668,466 | 6/1972 | Shimada | 315/169 TV |
| 3,723,789 | 3/1973 | Tanji | 313/497 |

*Primary Examiner*—Palmer C. Demeo
*Attorney, Agent, or Firm*—Hopgood, Calimafde, Kalil, Blaustein & Lieberman

[57] ABSTRACT

A multi-digit luminescence display tube comprises an anode assembly including a plurality of luminescent anode segments for each digit, a cathode, a plurality of grids disposed between the cathode and the anode segments of the respective digits, structure for supplying first voltages to the grids and to at least a selected one of the anode segments to make the same luminesce, and apparatus for superposing a second voltage on the first voltage supplied to at least a selected one of the grids to suppress luminescence at the anode segments covered thereby. The cathode comprises a common filament for the anode segments of all digits. Structure is provided for rendering the second voltage non-negative without adversely affecting the brightness of the selected anode segment which are not covered by the selected grid.

5 Claims, 7 Drawing Figures

MULTI-DIGIT LUMINESCENCE DISPLAY TUBE HAVING MEANS FOR SUPPLYING A POSITIVE OR ZERO VOLTAGE TO A SELECTED GRID TO SUPPRESS LUMINESCENCE OF ANODE SEGMENTS COVERED THEREBY

BACKGROUND OF THE INVENTION

This invention relates to electronic displays and, more specifically, to a luminescence display tube for simultaneously displaying a plurality of digits, which may be numerals, symbols, letters, and/or the like.

Luminescence display tubes have also been referred to as a fluorescence display tube or a phosphor indicator tube. As is described below with reference to the accompanying drawing, a multi-digit luminescence display tube comprises a cathode and an anode assembly comprising a substrate and a plurality of luminescent anode segments formed on the substrate for each of the digits. The cathode structure may comprise either a common filament for the anode segments of all digits, or individual filaments for the anode segments of the respective digits. Alternatively, the cathode may comprise two filaments for the anode segments of all digits.

The tube further comprises a plurality of grids between the cathode and the anode segments and first means for supplying first electric voltages between the cathode and the grids and between the cathode and at least a selected one of the anode segments for making the selected anode segment or segments to luminesce. The grids are in substantial registration with the anode segments of the respective digits and may be said to spatially cover the respective digits. The first voltages comprise a grid voltage and an anode or plate voltage. For a sophisticated luminescence display tube, a plate voltage of about 50 to 60 volts was supplied to the selected anode segment or segments. Use is made of a lower plate voltage, for example, of 24 volts for a recent luminescence display tube. An integrated driving circuit operable with a power source of about 24 volts, is also employed to drive the recent type luminescence display tube.

On the other hand, it is the practice for a multi-digit luminescence display tube to superpose a second electric voltage on the first voltage supplied between the cathode and selected of the grids to prevent the anode segments covered by the selected grid or grids from luminescing. The second voltage, however, has had to be negative with respect to the cathode potential. This has made it necessary to use a separate bias source to furnish the second voltage in addition to a principal voltage source for the driving circuit for energizing the luminescence display tube, with the concomitant additional expense of the second source.

The critical value of the second voltage for suppressing the luminescence of the selected anode segment or segments may be termed a cutoff grid voltage. It has already been known that the negative cutoff grid voltage may be lessened with a reduction in the percentage of geometrical coverage of the grid, namely, the ratio of the total cross-sectional area of the grid wires to the area generally covered by the grid. This, however, reduces the brightness of the luminescence. The negative cutoff grid voltage may also be lessened with a reduction in the filament voltage. This, however, necessitates the use of a separate filament for the anode segments of each digit which undesirably increases the power consumption of the tube and the variations in the brightness of the respective digits.

SUMMARY OF THE INVENTION

It is therefore an object of the present invention to provide a multi-digit luminescence display tube which does not require a separate bias source for supplying a voltage to selected grid or grids to suppress the luminescence of anode segments covered thereby.

It is another object of this invention to provide a tube of the type described, operable with a small power consumption.

It is still another object of this invention to provide a tube of the type described, which displays a plurality of digits with reduced variations in the brightness of the respective digits.

It is yet another object of this invention to provide a tube of the type described in which the display is as bright as that where a separate bias source is required.

A multi-digit luminescence display tube to which this invention is applicable comprises an evacuated sealed envelope, an anode assembly within the envelope including a substrate and a plurality of luminescent anode segments formed on the substrate for each of a plurality of digits, cathode means in front of the anode assebly for emitting thermal electrons, a plurality of grids between the cathode means and the anode segments in substantial registration with the anode segments of the respective digits, first means for supplying first electric voltages between the cathode means and the grids and between the cathode means and selected one or ones of the anode segments for distributing the thermal electrons substantially uniformly on the selected anode segment to make the same luminesce, and second means for superposing a second electric voltage on the first voltage supplied between the cathode means and a selected one or ones of the grids for preventing those anode segments from luminescing which are in substantial registration with the selected grid(s). In accordance with this invention, the cathode means comprises a common filament for the anode segments of all digits. Also, third means is provided for rendering the second voltage non-negative (i.e., of the same polarity as the first grid-cathode potential); without adversely affecting the luminescence of the selected anode segment(s) not in substantial registration with the selected grid.

DESCRIPTION OF THE PREFERRED EMBODIMENT

Figure 1:
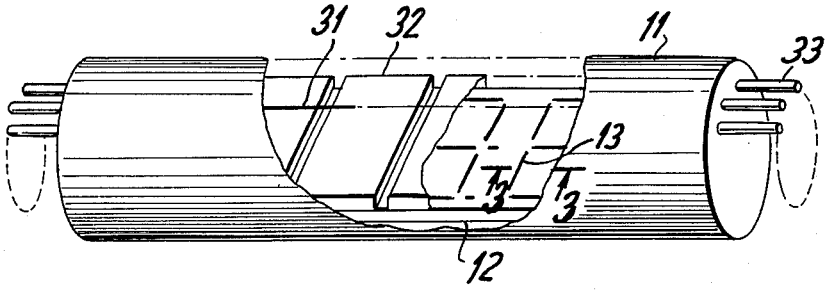
FIG. 1 is a schematic perspective view, partly cut away, of a multi-digit luminescence display tube according to an embodiment of the instant invention.
Figure 2:
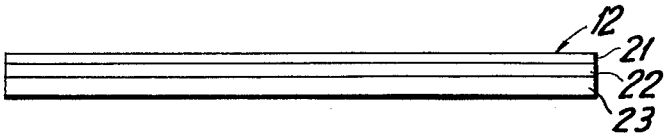
FIG. 2 shows a front view of an anode assembly of the display tube with the thickness exaggerated.
Figure 3:
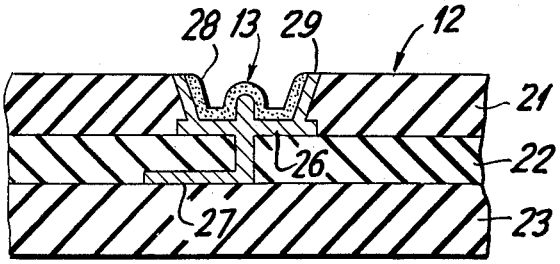
FIG. 3 is an enlarged fragmentary sectional view of the anode assembly taken on a plane indicated in FIG. 1 by a line 3—3.

Referring to FIGS. 1 through 3, a multi-digit luminescence display tube comprises an evacuated sealed envelope 11 and an anode assembly 12 within the envelope 11. The anode assembly 12 comprises a base plate or substrate formed of an insulating material and a plurality of luminescent anode segments 13. In FIG. 1, seven anode segments are formed on the substrate for each of the digits, the segments being arranged substantially in a "figure eight" pattern. Two additional anode segments are also employed for each digit to display a decimal point and for displaying the numeral 4 in a more visually agreeable shape. The substrate may comprise first, second, and third stacked base plates 21, 22, and 23 as best shown in FIGS. 2 and 3.

The first base plate 21 has a plurality of holes formed therethrough in conformity with the geometric configuration of the anode segments 13. The second base plate 22 has a plurality of electroconductive layers 26 formed on one of its surfaces in conformity with the anode segments 13 and extending wider than the cross-sectional areas of the corresponding holes formed through the first base plate 21. Each of the electroconductive layers 26 has a lead wire member extending through the second base plate 22 to the other surface. The third base plate 23 has a plurality of leads 27 formed on one of its surfaces for making electric contact with the respective lead wire members. After the base plates 21 through 23 are stacked together, the holes become grooves or recesses arranged in substantial geometric conformity with the anode segments 13. Each anode segment 13 comprises a layer 28 of a luminescent material covering the associated electroconductive layer 26 and may comprise an additional electroconductive layer 29 formed along each side surface of the respective holes and electrically contacting the pertinent electroconductive layer 26.

The tube further comprises a cathode or filament 31 disposed in front of the anode segments 13, a plurality of grids 32 between the cathode 31 and the anode segments 13 in substantial registration with the anode segments 13 of the respective digits, and structure such as stem studs 33 for supplying electric voltages between the cathode 31 and the grids 32, and between the cathode 31 and selected or ones of the anode segments 13 to make the cathode means 31 emit thermal electrons and to distribute the thermal electrons substantially uniformly on the selected anode segments(s) to render the energized segment(s) luminescent. First electric voltages may thus be supplied to the grids 32 and to selected anode segments to provide a desired plural digit display.

For further describing the present invention, it is assumed that second means is provided for superposing a second electric voltage on the first electric voltage supplied between the cathode 31 and a selected one (or ones) of the grids 32 for preventing that (or those) selected anode segment from luminescing which is covered or in substantial registration with the selected grid. Selection may be made of more than one of the grids 32. With respect to the embodiment illustrated in FIGS. 1 through 3, the second means may comprise some of the stem studs 33.

Figure 4:
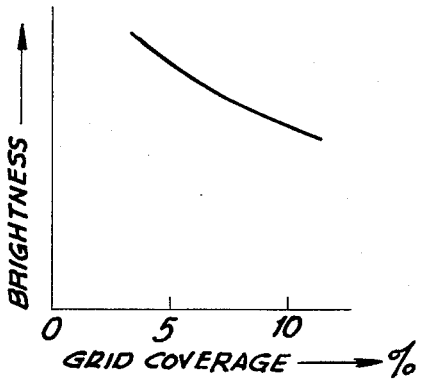
FIG. 4 is a graph illustrating the relationship between the brightness of luminescence and the percentage of grid coverage.
Figure 6:
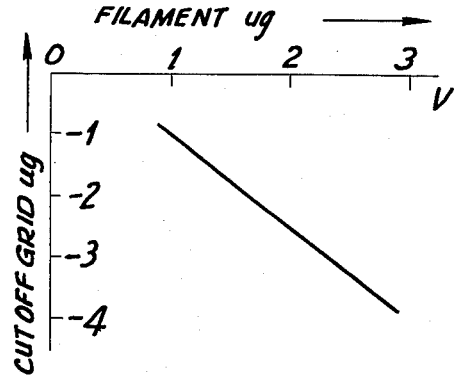
FIG. 6 shows cutoff grid voltage versus the filament voltage.
Figure 5:
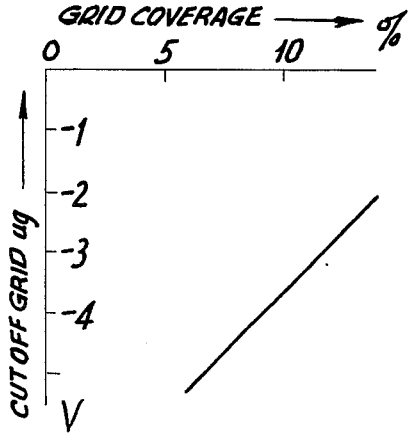
FIG. 5 plots cutoff grid voltages versus the percentage of grid coverage.

As described in the preamble of the instant specification, the cutoff voltage required to successfully suppress luminescence of the selected anode segment or segments has heretofore had to be negative (i.e., of the opposite polarity) with respect to the cathode potential. Referring to FIGS. 4 through 6, the brightness of the luminescence decreases with an increase in the percentage of geometrical coverage of the grids 32, although it is thereby possible to reduce the absolute value of the negative cutoff grid voltage. A reduction in the filament voltage also makes it possible to lessen the negative cutoff grid voltage. It has now been confirmed that a reduction in either the percentage of the grid coverage or in the filament voltage is not only objectionable from the viewpoints of various tube characteristics mentioned hereinabove but also cannot render the cutoff grid voltage zero or positive. In contrast, it has now been discovered that the cutoff grid voltage may be made zero or positive in accordance with this invention with the use of a common filament over the anode segments 13 of all digits and without adversely affecting the brightness of the luminescence of those selected anode segments which are not covered or in substantial registration with the selected grid.

Figure 7:
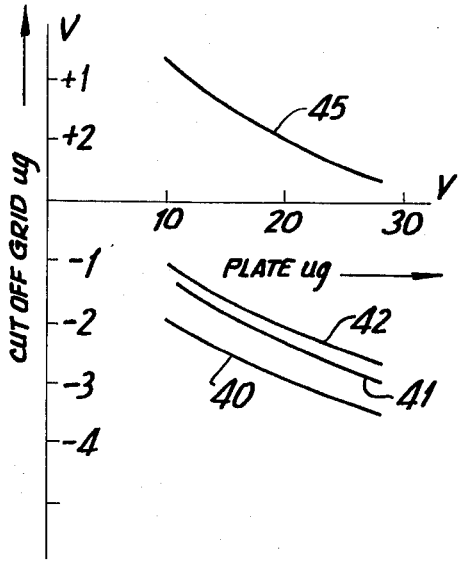
FIG. 7 illustrates the relationship between cutoff grid voltage and plate voltage.

Referring now to FIG. 7, a curve 40 shows cutoff grid voltage versus the plate voltage for a conventional six-digit luminescence display tube manufactured and sold with a trade name of DP60A by Ise Electronics Corporation of Ise-si, Japan. Curves 41 and 42 are for similar six-digit luminescence display tubes manufactured and sold with a trade name of LD8084 by Nippon Electric Kagoshima, Limited, of Kagoshima-ken, Japan, wherein the surface insulating layer of the anode assembly substrate is made of alumina having a dielectric constant ranging between 8.5 and 8.6 at 1 MHz, which may be the first base plate 21 illustrated with reference to FIGS. 2 and 3. Another curve 45 is for an LD8084 tube wherein the surface insulating layer is made of alumina of a dielectric constant ranging between 9.2 and 9.3 at 1 MHz. The rated plate voltage is 24 volts for both DP60A and LD8084. Although the rated filament voltages are 2.1 and 2.0 volts for DP60A and LD8084, respectively, it is seen that the negative cutoff grid voltage exemplified by the curve 40 is raised by about four volts to the positive range with the cutoff grid voltage versus plate voltage characteristics exemplified by the curve 45. Like studies have proved that it is possible to render the cutoff grid voltage non-negative by forming those portions of the anode assembly substrate which surround the anode segments 13 of an insulating material having a dielectric constant of 9.0 or more at 1 MHz.

What is claimed is:

1. In a multi-digit luminescence display tube comprising an evacuated sealed envelope having a light transparent portion, an anode assembly within said envelope disposed in a facing relationship with said envelope transparent portion, said anode assembly including an insulating substrate and a plurality of luminescent anode segments formed on said substrate for each of a plurality of digits, cathode means disposed in front of said anode assembly for emitting thermal electrons, a plurality of grids disposed between said cathode means and the anode segments in substantial registration with the anode segments of the respective digits, first means for supplying first electric voltages between said cathode means and said grids and between said cathode means and at least a selected one of said anode segments for distributing the thermal electrons substantially uniformly on the selected anode segment to make said electron-irradiated segment luminesce, and second means for superposing a second electric voltage on the first voltage supplied between said cathode means and at least a selected one of said grids for preventing those anode segments from luminescing which are in substantial registration with the selected grid, the improvement being wherein said cathode means comprises a common filament for the anode segments of all digits, and further comprising third means for rendering said second voltage non-negative and greater than zero such that the luminescence of that selected anode segment which is not in substantial registration with the selected grid is not adversely affected.

2. A tube as claimed in claim 1, wherein said third means comprises an insulating material having a dielectric constant of at least 9.0 at 1 MHz forming those portions of said substrate which surround said anode segments.

3. A tube as claimed in claim 2, wherein said insulating material is alumina.

4. In combination in a luminescence display tube, an evacuated envelope at least a portion of which is light transparent, a substrate disposed within said envelope, plural luminescent anode segments disposed on said substrate and disposed in a facing relationship with said light transparent portion of said envelope, said substrate about the area of said anode segments comprising means characterized by a dielectric constant of at least 9.0 at 1 MHZ, electron emitting cathode means, plural grid means disposed intermediate said cathode means and said anode segments, differing of said grids being associated with differing of said anode segments, means for selectively supplying a display enabling driving potential of a given polarity between at least one of said luminescent anodes and said cathode means, and display component quashing means for selectively supplying a potential of a like polarity between at least one of said grids and said cathode means.

5. A combination as in claim 4 wherein said substrate about the area of said anode segments comprises alumina.

* * * * *